US012448798B2

(12) United States Patent
Burk et al.

(10) Patent No.: US 12,448,798 B2
(45) Date of Patent: Oct. 21, 2025

(54) FLOOR STRIPPER MACHINE

(71) Applicant: National Flooring Equipment, Inc., Minneapolis, MN (US)

(72) Inventors: Matthew C. Burk, Forest Lake, MN (US); Cole Willard, Maple Grove, MN (US)

(73) Assignee: NATIONAL FLOORING EQUIPMENT, INC., Minneapolis, MN (US)

( * ) Notice: Subject to any disclaimer, the term of this patent is extended or adjusted under 35 U.S.C. 154(b) by 586 days.

(21) Appl. No.: 17/748,745

(22) Filed: May 19, 2022

(65) Prior Publication Data

US 2023/0374802 A1 Nov. 23, 2023

(51) Int. Cl.
*E04G 23/00* (2006.01)

(52) U.S. Cl.
CPC ..... *E04G 23/006* (2013.01)

(58) Field of Classification Search
CPC ..... E04G 23/006
See application file for complete search history.

(56) References Cited

U.S. PATENT DOCUMENTS 986,761 A * 3/1911 Roscoe ..... B23B 31/103 403/301
3,860,858 A * 1/1975 Nola ..... H02P 27/08 318/801
4,162,809 A 7/1979 Anderson et al.
4,330,938 A * 5/1982 Martin ..... E04G 23/006 30/169
4,626,033 A 12/1986 Anderson
4,963,224 A * 10/1990 Anderson ..... E04G 23/006 156/763
5,288,161 A * 2/1994 Graves ..... B25G 3/18 403/324
5,713,637 A * 2/1998 Worden ..... E04G 23/006 15/93.1
5,772,284 A * 6/1998 Lindsey ..... E04G 23/006 15/93.1
6,092,876 A * 7/2000 Arbucci ..... E04G 23/006 15/93.1
6,135,566 A * 10/2000 Anderson ..... E04G 23/006 299/37.1
6,578,931 B1 6/2003 Anderson
6,609,762 B2 8/2003 Anderson
10,273,700 B2 * 4/2019 Anderson ..... E04G 23/006
(Continued)

FOREIGN PATENT DOCUMENTS

CA 2255290 A1 * 6/2000 ..... B24B 7/186
JP 2017095906 A 6/2017
(Continued)

OTHER PUBLICATIONS

Korean Intellectual Property Office, International Search Report and Written Opinion of the International Search Authority dated Sep. 18, 2023, 13 pages.

*Primary Examiner* — Janine M Kreck
(74) *Attorney, Agent, or Firm* — Bradley J. Thorson; DeWitt LLP

(57) ABSTRACT

Employing a microcomputer and a user interface to control the operation of various motors and a linear actuator of a floor stripper improves efficiency and effectiveness while reducing vibration and sound levels during a floor stripping operation.

15 Claims, 12 Drawing Sheets

(56) References Cited

U.S. PATENT DOCUMENTS

| | | | | |
|---|---|---|---|---|
| 10,443,254 | B2 | 10/2019 | Burk | |
| 2002/0190568 | A1* | 12/2002 | Anderson | E04G 23/006 299/37.1 |
| 2013/0292146 | A1* | 11/2013 | Fellhauer | A47L 11/28 173/1 |
| 2017/0129126 | A1 | 5/2017 | Rubens et al. | |
| 2019/0106893 | A1 | 4/2019 | Anderson et al. | |

FOREIGN PATENT DOCUMENTS

| | | | | |
|---|---|---|---|---|
| KR | 100794396 | B1 | 1/2008 | |
| WO | WO-2011094719 | A1 * | 8/2011 | E04G 23/006 |

* cited by examiner

FLOOR STRIPPER MACHINE

CROSS-REFERENCED TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to machines for stripping materials, such as adhesive bonded floor coverings from floor surfaces, and more particularly to improved machines of this type incorporating a novel balancing system and a microcomputer that separately controls motors for driving an oscillating body, a blade pitch adjustment mechanism, and each of the machine's drive wheels in a manner that reduces vibration and noise.

2. Discussion of the Prior Art

In 1979, Lloyd E. Anderson was awarded U.S. Pat. No. 4,162,809 on a motorized carpet and tile stripping machine that comprised a box-like housing mounted on a pair of wheels disposed near the rear of the housing and a cutting blade projecting outwardly from the front of the housing and adapted to engage the ground beneath a floor covering that had been adhesively bonded to the floor. Supported on an upper deck of the housing was an electric motor whose output shaft was coupled to the machine's cutting head by means of an eccentric drive shaft such that the cutting head was made to move in an orbital or elliptical pattern. An elongated handle was also affixed to the upper deck of the housing and sloped rearward and upward terminating in handle grips.

When this machine was used to strip a floor covering, such as adhesively bonded carpeting from a concrete floor, the operator would first use a knife to cut the carpeting into strips. Next, the stripping machine would be placed at one end of the cut strip with its cutting head disposed in the interface between the carpeting and floor. The operator would then activate the motor to cause the cutting blade to orbitally rotate while he manually urged the machine forward by pushing against the handle.

While the machine made in accordance with U.S. Pat. No. 4,162,809 was somewhat effective in its operation, it required a high degree of manual effort and vibrated excessively making it somewhat difficult to control. Also, there was no mechanism that allowed the pitch of the blade holder to be adjusted relative to the machine or the floor. As such, the blade held by the blade holder had to be changed to adjust the blade's angle of attack (i.e., angle of impact) relative to the floor and the floor coverings to be removed.

In 1986, Lloyd Anderson's son, Martin, was awarded U.S. Pat. No. 4,626,033. In this patent, Martin described an improvement made to his father's design to make the machine easier for an operator to control. Specifically, Martin added a motion retainer bar assembly between the machine's frame and the cutting head's drive bar to modify the degree of eccentricity between the drive bar and the shaft of the electric drive motor. While this improvement did make the machine somewhat easier to control, vibration remains somewhat excessive and the cutting blade actuation, while separating the carpeting from the floor, left considerable adhesive residue on the floor. This was because there was no effective way to adjust the angle of attack of the blade's leading edge. The blade would still need to be changed to a blade of a different configuration to provide a change to the angle of attack.

In U.S. Pat. No. 4,963,224, Martin Anderson described yet another improvement that he made to the floor stripping machine to reduce vibration. He designed in a pair of OILITE® sleeve bearings and affixed a pair of guide rods to the cutting head and which fit into the sleeve bearings to thereby constrain motion of the cutting head to reciprocating, back-and-forth movement parallel to the path of travel of the machine. While this improvement did, in fact, reduce machine vibration and prolong its useful life, minimizing its mean time to repair, no improvement was seen in the ability of the machine to remove adhesive residue from the floor following the stripping of the carpet therefrom. There was still no effective way to adjust the angle of attack of the blade's leading edge, and the blade would still need to be changed to a blade of a different configuration to provide a change to the angle of attack.

In 2000, Martin Anderson was awarded U.S. Pat. No. 6,135,566 based on still other improvements to walk-behind floor stripping machines of the type described above. In this patent, he disclosed a machine that significantly increased the downward force of the machine's cutting blade against the floor by drastically increasing the overall weight of the machine. The scraping action of the cutting blade, when being pressed down on the floor by the weight of the machine, markedly improved its ability to remove adhesive residues. There was still no mechanism that allowed the pitch of the blade holder to be adjusted relative to the machine or the floor. Thus, the only way to adjust the attack angle of the leading edge of the blade relative to the floor, and the material to be removed from the floor, was to change to a different blade.

U.S. Pat. No. 6,609,762 was granted to Martin Anderson on Aug. 26, 2003. This patent describes a hydraulically powered self-propelled stripping machine having an electric motor driving a pump for pumping hydraulic fluid to hydraulic motors that turned axles coupled to the wheels. The hydraulic circuit included valves that could be actuated to control the speed and direction of the machine. There was, again, no mechanism that allowed the pitch of the blade holder to be adjusted relative to the machine or the floor making it necessary to change to a different blade having a different configuration to adjust the attack angle of the leading edge of the blade.

Accordingly, the present invention provides a novel blade pitch adjustment mechanism allowing the attack angle of a blade coupled to a blade head of a walk-behind floor stripping machine, and the materials being removed from the floor, to be adjusted without swapping the blade for a blade of a different configuration. The present invention also provides improved machines of this type incorporating a novel balancing system and a microcomputer that separately controls motors for driving an oscillating body, a blade pitch adjustment mechanism, and each of the machine's drive wheels in a manner that reduces vibration and noise.

SUMMARY OF THE INVENTION

The present invention relates to machines for stripping floor coverings from floor surfaces. Such a machine includes a frame supported on a pair of drive wheels driven by separate motors. In some embodiments, such motors are electric motors coupled to variable frequency drives. In other embodiments, such motors are hydraulic motors coupled to solenoid-controlled valves adapted to regulate the flow of hydraulic fluid to the hydraulic motors.

The machine also included an oscillating body, such as a plate, driven by an eccentric and a motor. This motor, again, can be an electric motor coupled to a variable frequency drive, or a hydraulic motor coupled to solenoid-controlled valves adapted to regulate the flow of hydraulic fluid to the hydraulic motor. A blade head is coupled to the oscillating body by a novel blade head adjustment mechanism. The blade head is adapted to couple a stripping blade to the machine and the blade head adjustment mechanism permits adjustment of the attack angle of the blade relative to the oscillating body, the floor, and the material to be stripped from the floor.

In one embodiment, this novel blade pitch adjustment mechanism comprises a first bar fixed to the oscillating body driven by the eccentric and motor. This first bar comprises a lower section, an upper section, and a rearwardly projecting section. The novel blade pitch adjustment mechanism also comprises an output link having a first end and second end. The output link pivotally coupled adjacent its first end to the lower section of the first bar and pivotally coupled adjacent its second end to the head. Additionally, this novel blade pitch adjustment mechanism comprises a bellcrank including a hub, a first arm extending from the hub and pivotally coupled to the rearwardly projecting section of the first bar and a second arm extending from the hub and pivotally coupled to the head. A linear actuator comprising a motor is coupled to the hub and adapted to cooperate with the first bar, the output link, and the bellcrank to adjust the pitch of the head relative to the oscillating body, and thus the angle of attack of the blade coupled to the blade head relative to the floor and the material being removed from the floor.

Various types of linear actuators may be used. Typically, the linear actuator will be an electro-mechanical linear actuator. Such electro-mechanical may include a stepper motor or a sensor adapted to determine the state of the linear actuator. Alternatively, the motor may be a hydraulic cylinder coupled to valves controlled by solenoids. In either case, the linear actuator is coupled to the hub of the bellcrank and to the upper section of the first bar. Where the first bar and the second bar of the bellcrank are attached to the head may vary. In some embodiments the lower section of the first bar is attached to a center portion of the head and the second arm of the bellcrank is pivotally coupled to an upper portion of the head.

Extending upwardly and rearwardly from the frame is a handle equipped with a user interface coupled to a programmable microcomputer which processes and responds to inputs received from the user interface to send control signals to various devices and thereby control the machine's operation. The state and speed of each of the motors are all governed by the microcomputer based on user inputs from the user interface. The length of the linear actuator may also be controlled by the microcontroller or by a separate mechanism.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
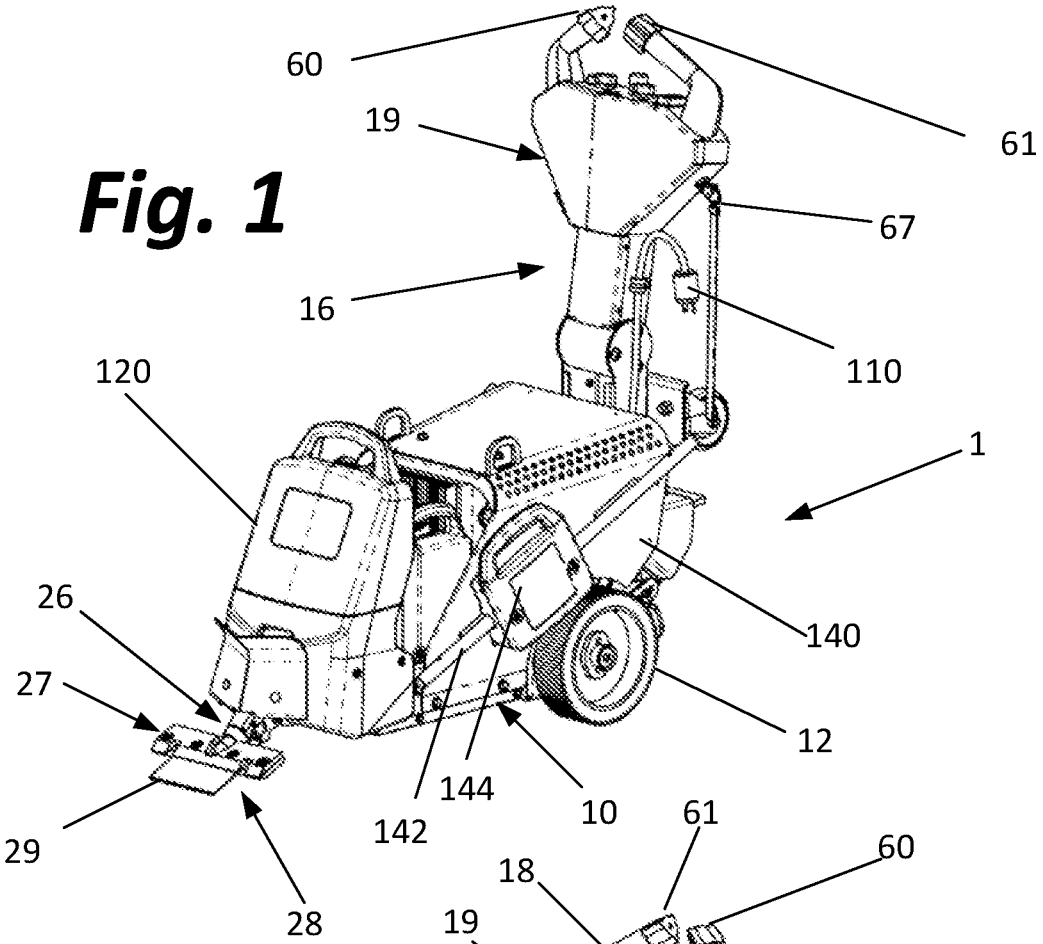
FIG. 1 is perspective view of a floor stripping machine made in accordance with the present invention.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

Figure 2:
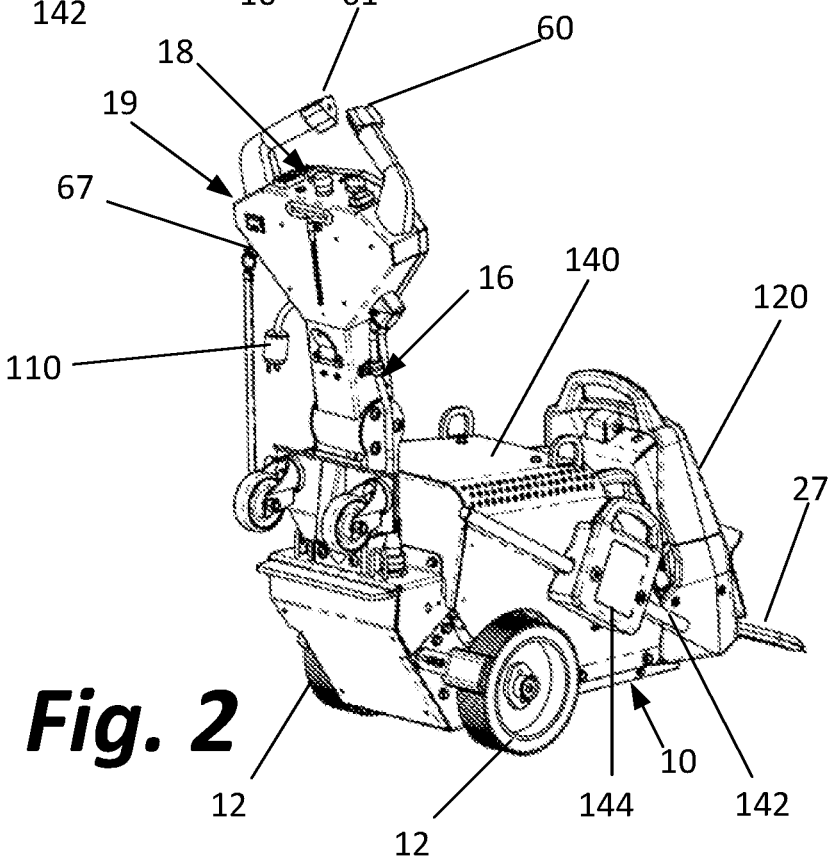
FIG. 2 is a second perspective view of the floor stripping machine of FIG. 1.
Figure 3:
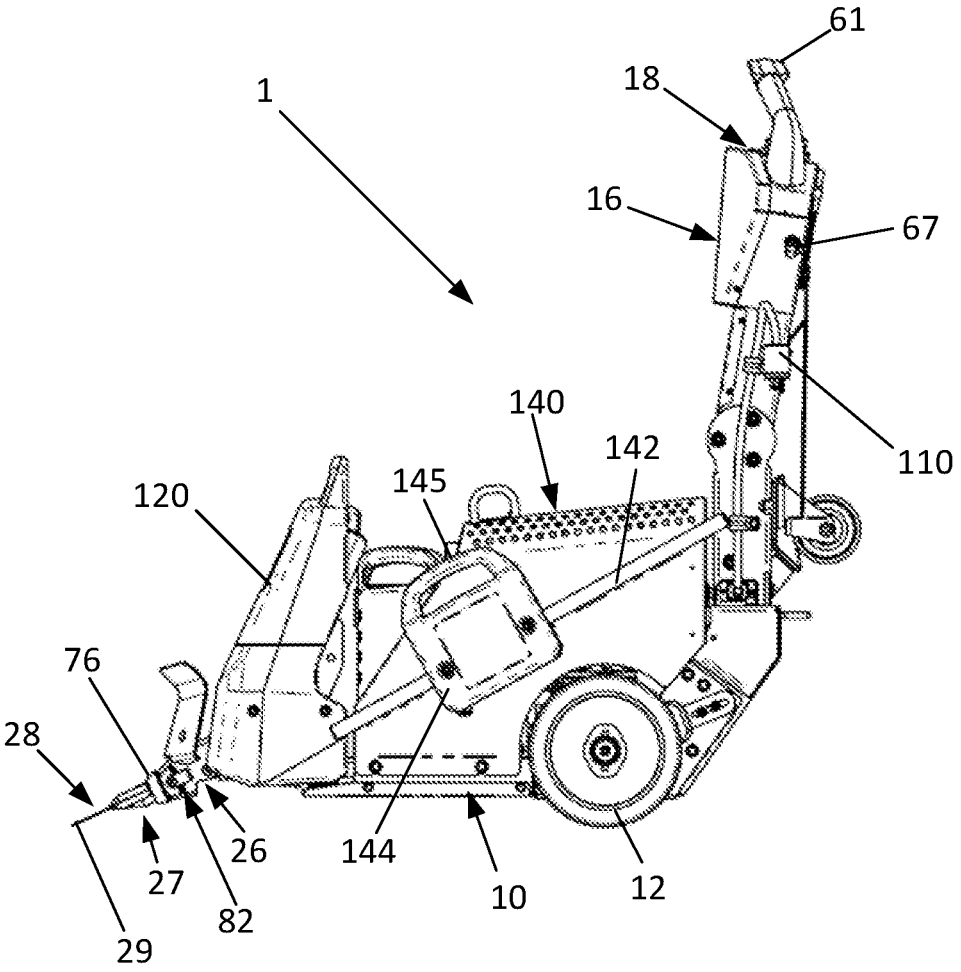
FIG. 3 is a side view of the floor stripping machine of FIG. 1.
Figure 11:
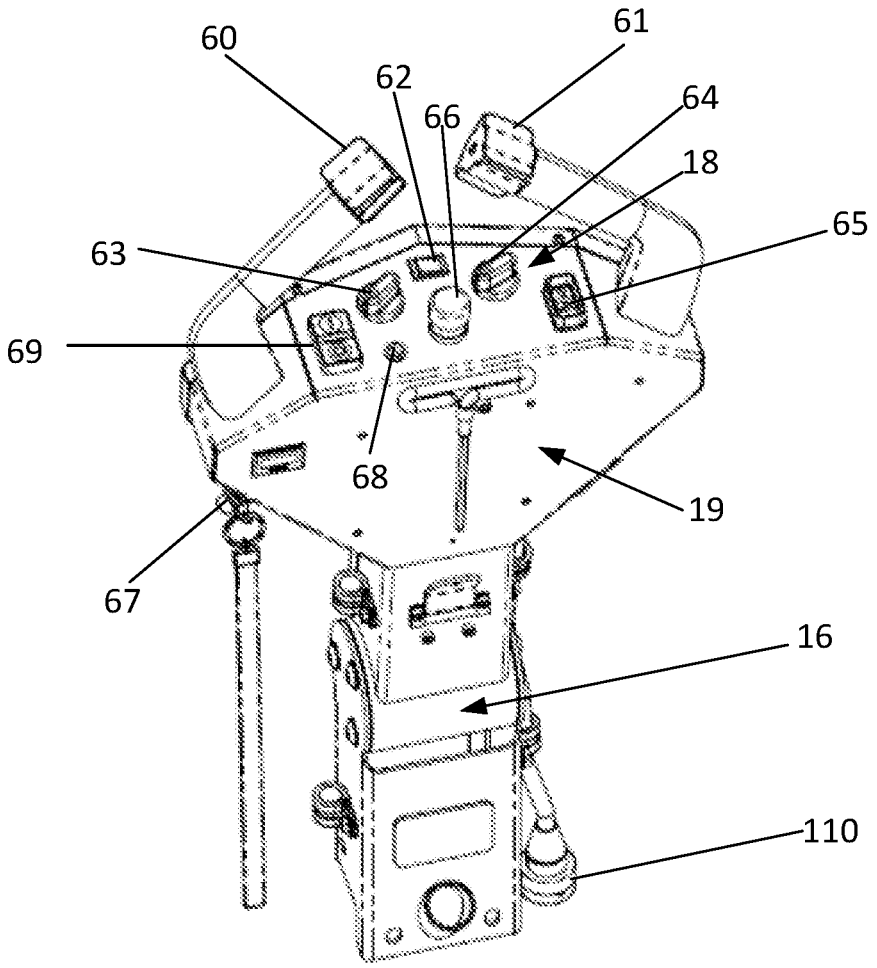
FIG. 11 is a perspective view of the handle and user interface of the floor stripping machine of FIG. 1.
Figure 16:
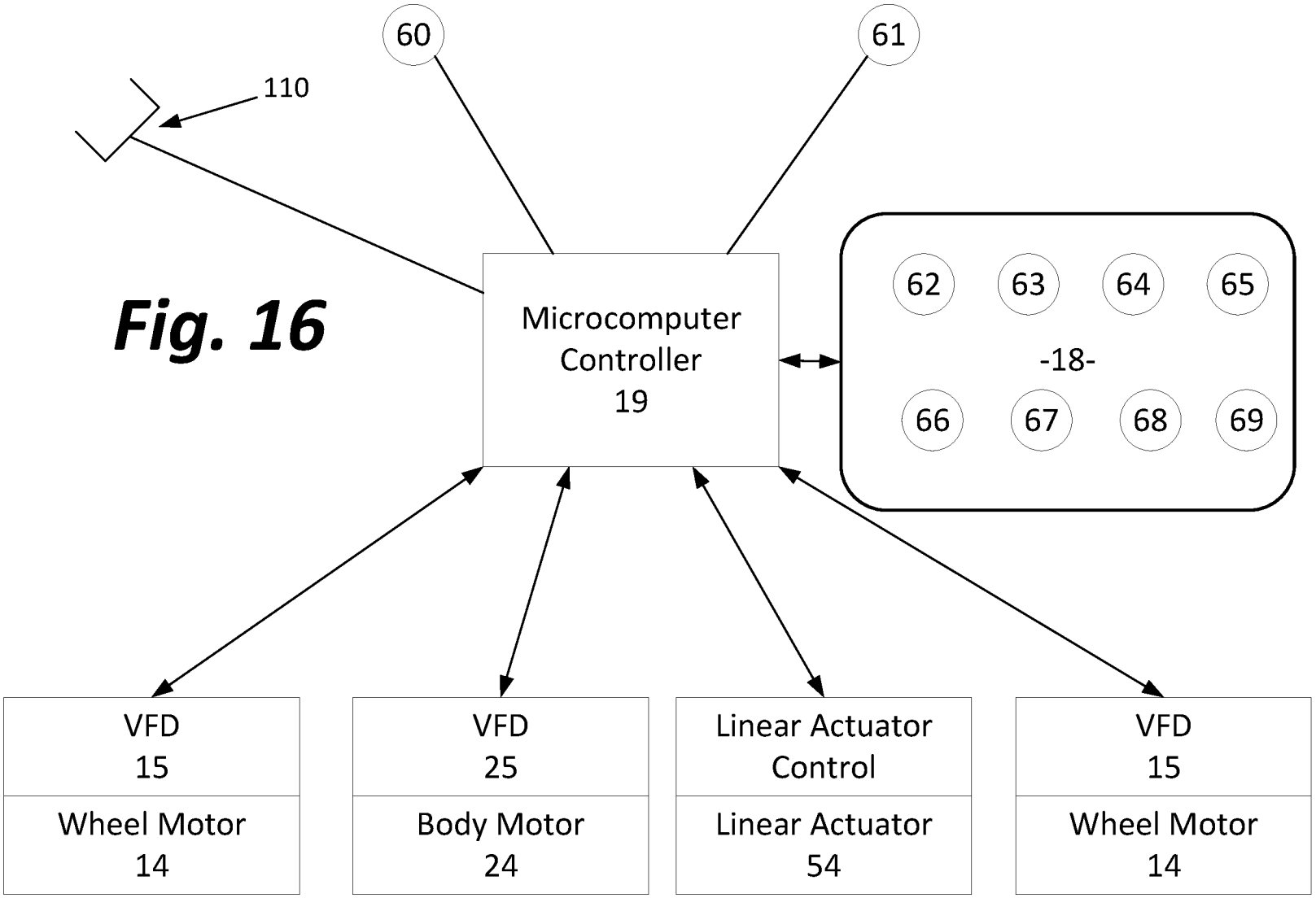
FIG. 16 is a schematic diagram illustrating a first way of controlling the floor stripping machine of FIG. 1 when electric motors are used.

A self-propelled machine 1 for stripping adhesive-backed floor coverings from floor surfaces is shown generally in FIGS. 1 through 3. The machine 1 includes a frame 10 supported by a pair of drive wheels 12. Extending upwardly and rearwardly from the frame 10 is a handle 16 equipped a microcomputer 19 (also sometimes referred to herein as controller 19) and a user interface 18 comprising a plurality of dials, switches and indicator lights 60-69 as best shown in FIGS. 11 and 16. Alternatively, the user interface 18 can be a touch screen. The handle 16 includes hand grips. Thumb wheel control dials (spinners) 60/61 are mounted to the hand grips. The thumb wheel control dials 60/61 and the other dials and switches of the user interface send signals to the microcomputer 19 which controls operation of the machine 1 based on such signals. Power is supplied to the machine 1 by attaching an extension cord (not shown) to the plug 110 and to a standard electrical socket.

Figure 9:
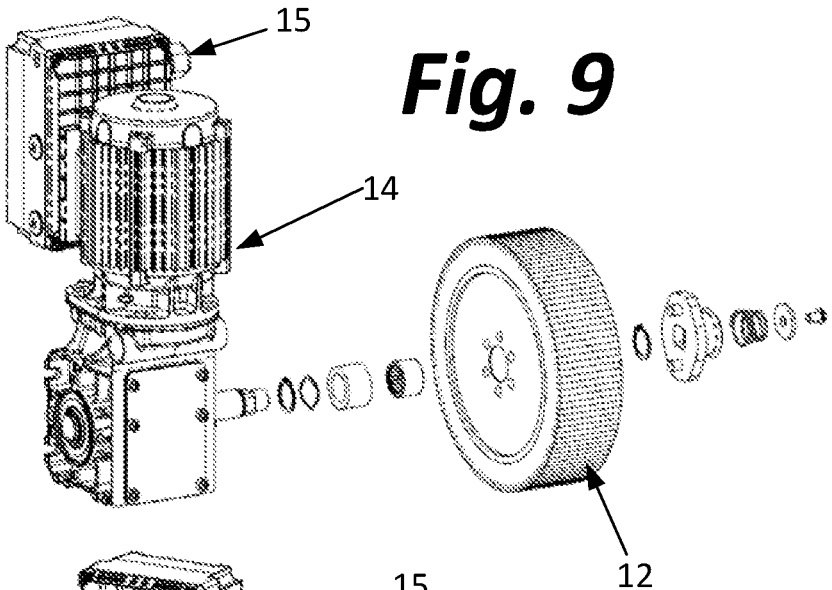
FIG. 9 is a perspective view of a drive wheel and motor assembly of the floor stripping machine of FIG. 1.
Figure 10:
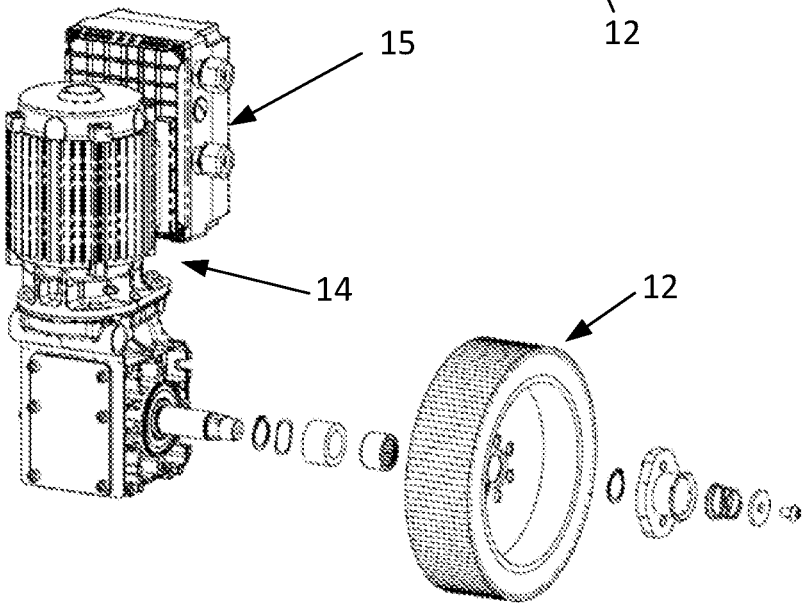
FIG. 10 is a second perspective view of a drive wheel and motor assembly of the floor stripping machine of FIG. 1.

The drive wheels 12 each separately driven by separate variable speed wheel motors 14 as illustrated in FIGS. 9 and 10. In various embodiments, the variable speed wheel motors 14 are each coupled to a variable frequency drive 15 which receives signals from the controller 19 and convert those signals into currents that cause the motor 14 to operate at desired speeds.

Figure 4:
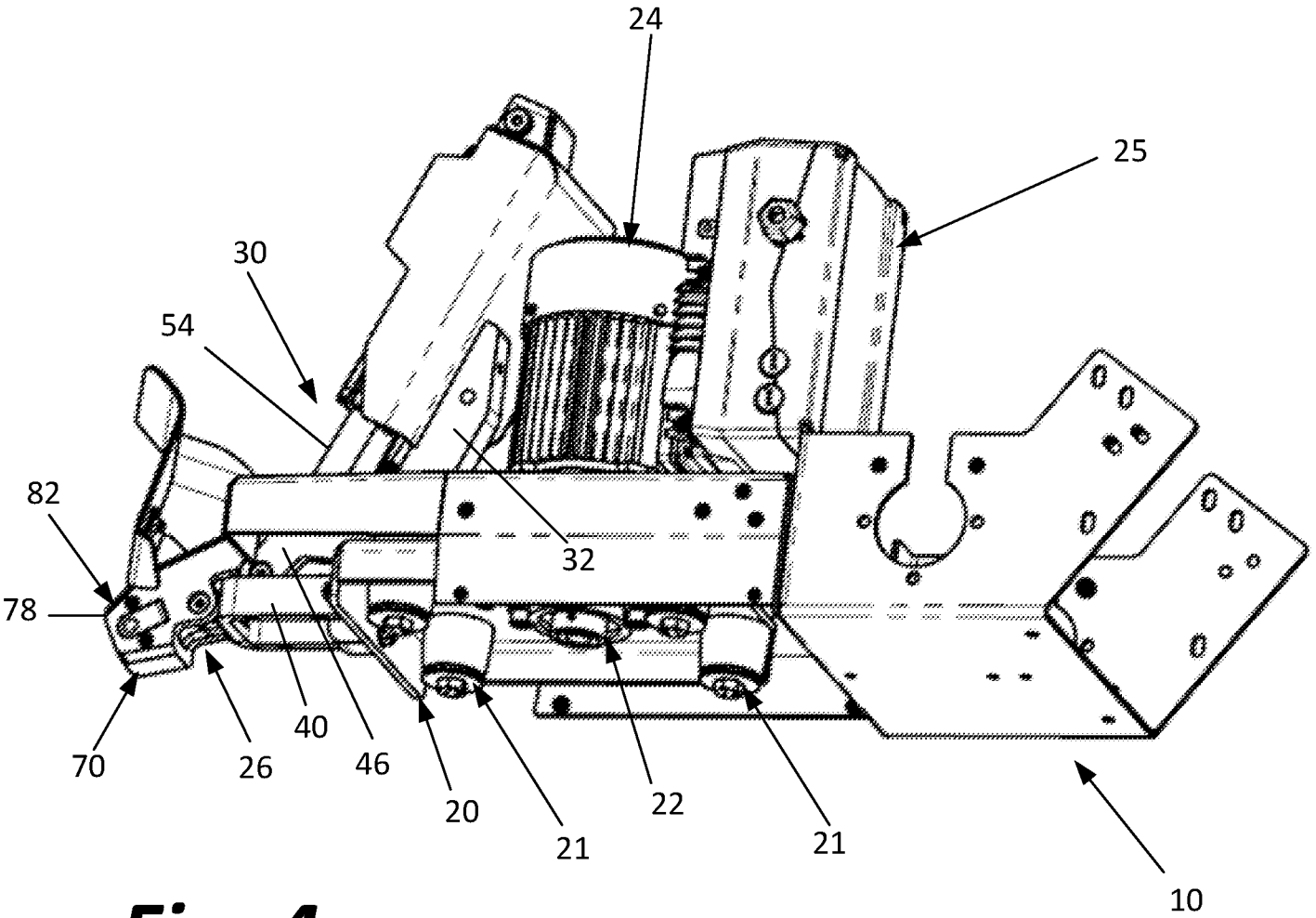
FIG. 4 is a perspective view showing the blade pitch adjustment and oscillation mechanisms of the floor stripping machine of FIG. 1.
Figure 5:
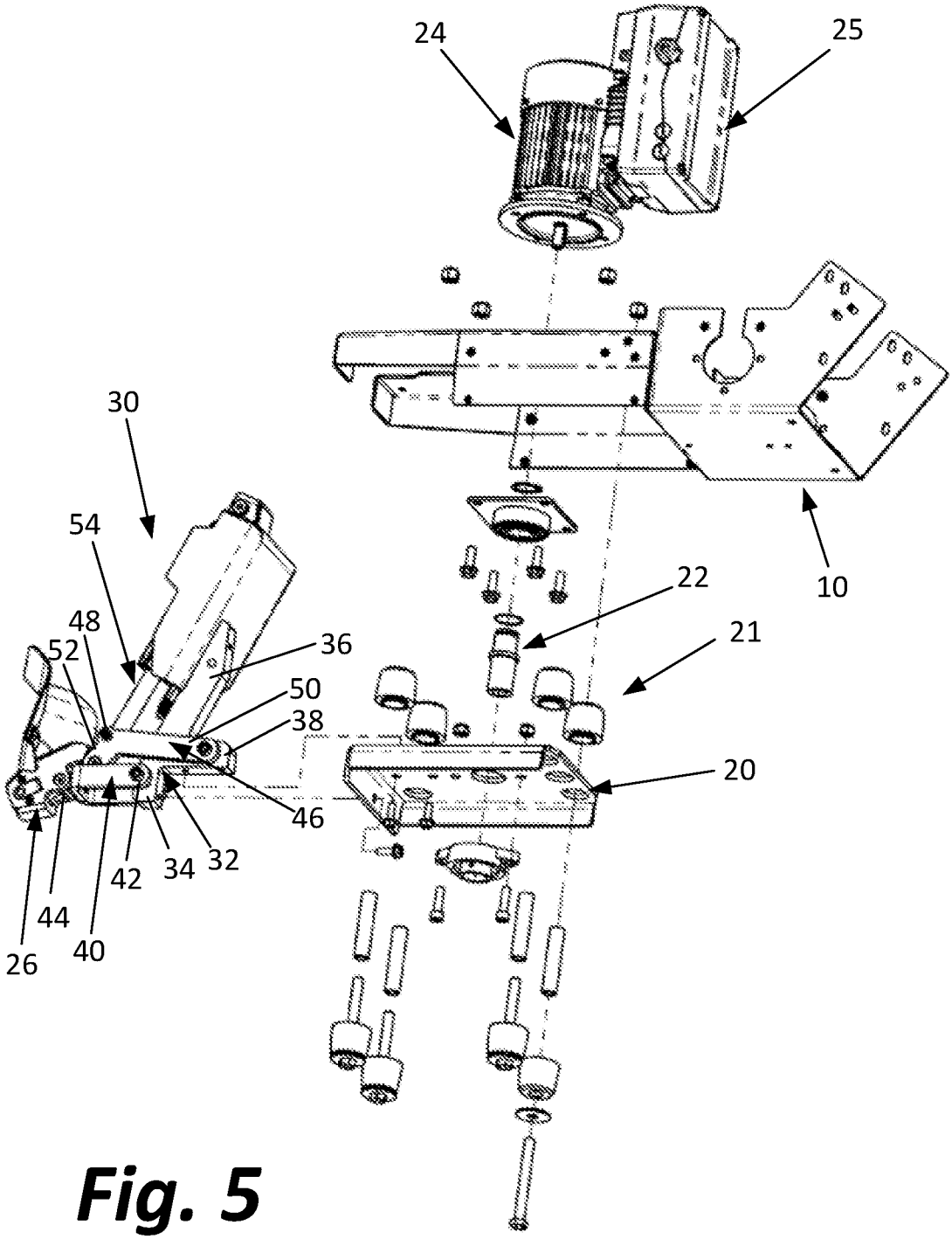
FIG. 5 an exploded view showing the blade pitch adjustment and oscillation mechanisms of FIG. 4.
Figure 6:
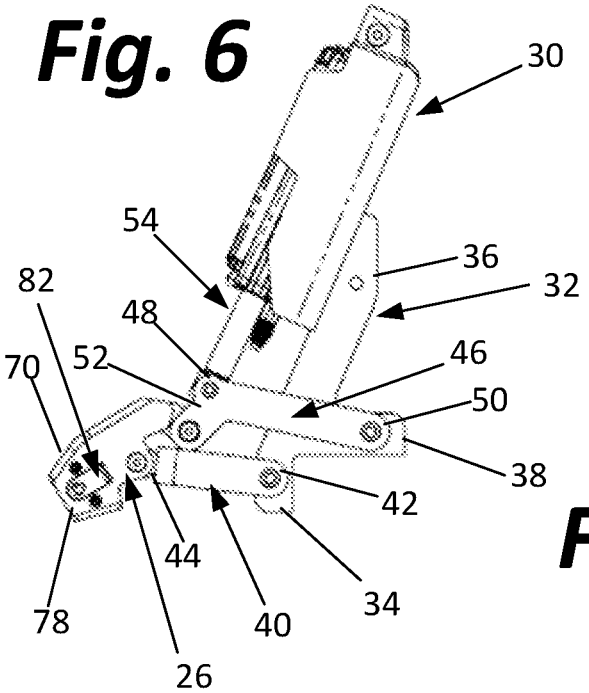
FIG. 6 is a side view of the blade pitch adjustment mechanism of FIG. 4.
Figure 7:
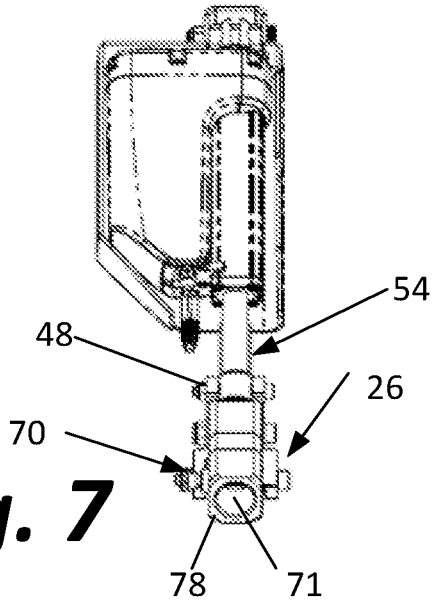
FIG. 7 is a front view of the blade pitch adjustment mechanism of FIG. 4.
Figure 8:
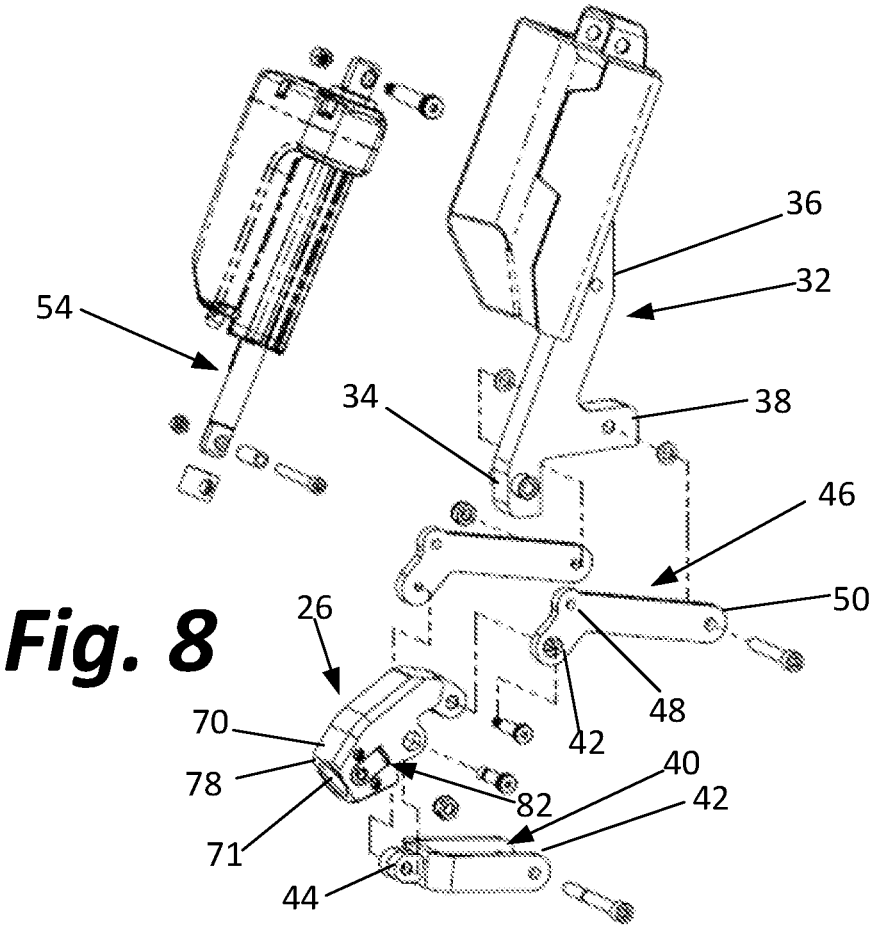
FIG. 8 an exploded view showing the blade pitch adjustment mechanism of FIG. 4.

As shown in FIGS. 4 and 5, the machine 1 also includes an oscillating body 20 coupled to the frame using a plurality of isolator assemblies 21 in a fashion like that described and in U.S. Pat. No. 10,443,254 granted Oct. 15, 2019, to Burk and incorporated herein in its entirety by reference. The oscillating body 20 is driven by an eccentric 22 and a variable speed body motor 24. The variable speed body motor 24 is coupled to a variable frequency drive 25 which receives signals from the controller 19 and convert those signals into currents that cause the motor 24 to operate at a desired speed. A blade head 26 coupled to the oscillating body 20 by a novel blade pitch adjustment mechanism 30. The blade head 26 is used to couple a stripping blade 28 to the machine 1 via a tool 27.

This blade pitch adjustment mechanism 30 is coupled the blade head 26 and to the oscillating body 20. The blade pitch adjustment mechanism 30 is adapted to facilitate adjustment of the angle of the blade head 26 relative to the oscillating body 20. As such, the attack angle of the leading edge 29 of a blade 28 attached to the blade head 26 by a tool 27 is also adjusted, not only relative to the oscillating body 20, but also relative to the floor and the material to be stripped from the floor.

In the embodiment shown in FIGS. 4 through 8, this novel blade pitch adjustment mechanism 30 comprises a first bar 32 fixed to the oscillating body 20 driven by the eccentric 22 and the body motor 24. This first bar 32 comprises a lower section 34, an upper section 36, and a rearwardly projecting section 38. The blade pitch adjustment mechanism 30 also comprises an output link 40 having a first end 42 and second end 44. The output link 40 is pivotally coupled adjacent its first end 42 to the lower section 34 of the first bar 32 and pivotally coupled adjacent its second end 44 to the blade head 26. Additionally, the blade pitch adjustment mechanism 30 comprises a bellcrank 46 comprising a hub 48, a first arm 50 extending from the hub 48 and pivotally coupled to the rearwardly projecting section 38 of the first bar 32 and a second arm 52 extending from the hub 48 and pivotally coupled to the blade head 26. A linear actuator 54 is coupled to the hub 48 and adapted to cooperate with the first bar 32, the output link 40, and the bellcrank 46 to adjust the pitch of the blade head 26 relative to the oscillating body 20, and thus the angle of attack of the blade 28 coupled to the blade head 26 relative to the floor and the material being removed from the floor.

Various types of linear actuators 54 may be used. Where the first bar 32 and the second arm 52 of the bellcrank 46 are attached to the blade head 26 may vary. In some embodiments the lower section 34 of the first bar 32 is attached to a center portion of the blade head 26 and the second arm 52 of the bellcrank 46 is pivotally coupled to an upper portion of the blade head 26.

A user interface 18 comprising a plurality of dials, switches and indicator lamps, many of which are coupled to the controller/microcomputer 19. This user interface 18 is used by an operator to control the speed of the wheel motors 14 and the body motor 24. Likewise, the length of the linear actuator 54 is adjusted using this the user interface.

The user interface 18 include a pair of proportional thumb spinners 60 and 61. Both send signals to the controller 19 which, based on these signals, controls operation, direction of rotation and speed of rotation of the variable speed wheel motors 14. More specifically, one of the of proportional thumb spinners is used to cause the machine 1 to move forward or backward across the floor at a selectable speed while the other provides for turning, including zero-radius turning. Which function is assigned to the proportional thumb spinners 60 and 61 is governed by a selection switch 62 also in communication with the controller 19. This arrangement provides the ability to steer with one hand and control the speed and direction of the machine 1 with the other.

The user interface 18 also include a pair of speed dials 63/64, each in communication with the controller 19. Speed dial 63 limits the maximum speed of the variable speed wheel motors 14 and speed dial 64 limits the maximum speed of the variable speed body motor 24. The user interface 18 also include a switch 65 used to extend and retract the linear actuator 54 and thereby adjust the pitch of the blade head 26 relative to the oscillating body 20, and thus the angle of attack of the blade 28 coupled to the blade head 26 relative to the floor and the material being removed from the floor. FIG. 16 shows switch 65 and the linear actuator control/linear actuator 54 coupled to the microcomputer controller 19. However, the switch 65 may be coupled directly to the linear actuator control/linear actuator 54, rather than via the microcomputer controller 19, without deviating from the invention. An emergency stop switch 66 and an operator presence safety strap 67 are also provided. Status indicators 68 and 69 are also provided to signal various operating conditions to a user.

As noted above, the speed of the body motor 24 is adjusted by an operator of the machine 1 using a dial 64. Based on the position set by an operator of this dial 64, the controller 19 controls the speed of the oscillation action of the blade head 26 (driven by the oscillating body 20, eccentric 22 and motor 14) within a predefined frequency. The operator will set the position of dial 64 based on various factors. Accounting for the type of blade 28 attached to the blade head 26 and the type of flooring material being removed from the floor, the operator can adjust the variable speed of motor 14 of the machine 1 to maximize the removal rate. The operator can also use the dial 64 to reduce the speed of the body motor 24 to minimize unnecessary sound pressure, sound power levels, and hand-arm vibration whenever a higher speed is unnecessary. Further, the controller's software is designed to not operate close to known resonant frequencies (harmonics) or nodes. This reduces hand-arm vibration, power pressure, sound power levels, and wear on moving components thus extending the life of such components and improving the overall experience of the operator.

Figure 12:
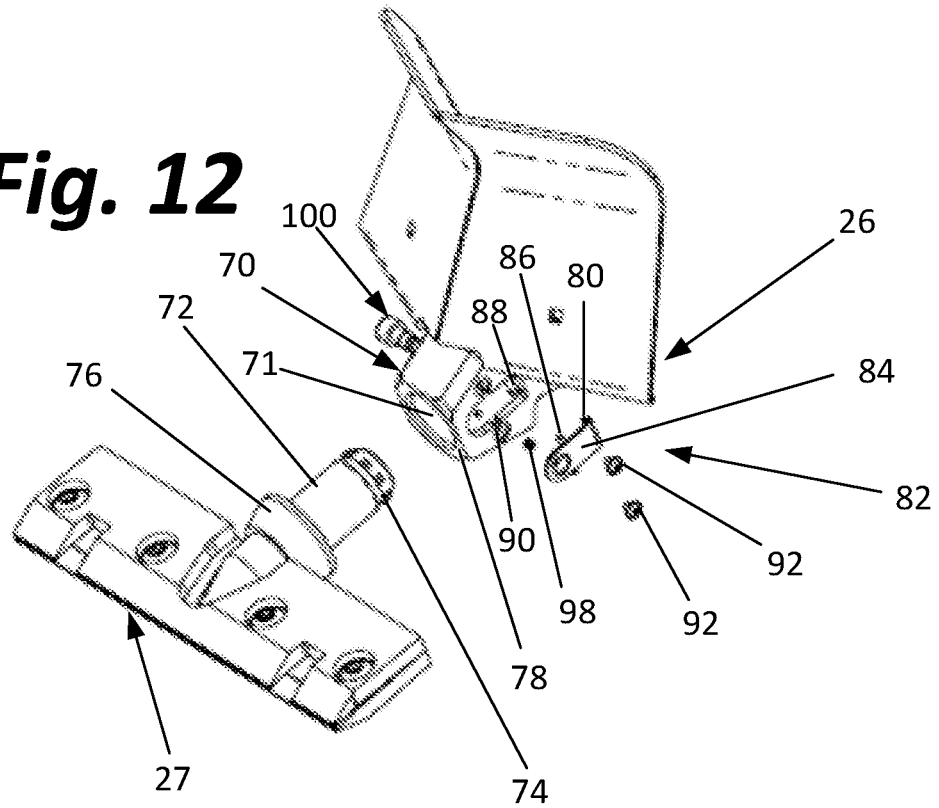
FIG. 12 is a perspective view showing how a blade holding tool is attached to the floor stripping machine of FIG. 1.
Figure 13:
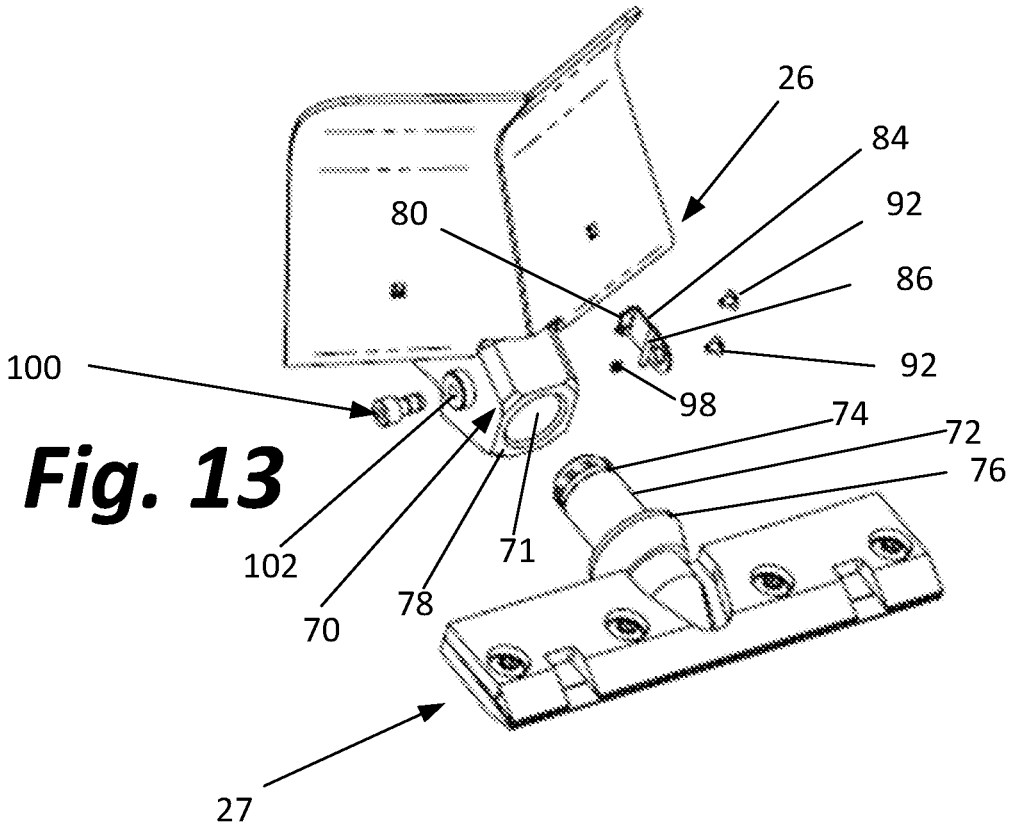
FIG. 13 is a second perspective view showing how a blade holding tool is attached to the floor stripping machine of FIG. 1.

As shown in FIGS. 12 through 13, the blade head 26 is adapted to be coupled to a blade holding tool 27 comprising a shaft 72. The blade head 26 has a neck 70 including a bore 71 adapted to receive a shaft 72 of the tool 27. The shaft 72 and the bore 71 are sized so that the shaft 72 can be inserted into the bore 71 and rotate within the bore 71 to provide an automatic adjustment accommodating unlevel floors. The shaft 72 is provided with at least one annular groove 74 extending around the shaft 72 and a stop 76 in the form of a collar also extending around the shaft 72. The annular groove 74 and the stop 76 are a predetermined distance apart. The tool 27 is coupled to the blade head 26 by inserting the shaft 72 through the bore 71 of the neck 70 until the stop 76 engages the front surface 78 of the neck 70. The shaft 72 is retained in the bore 71 by a retaining tab 80 that snaps into the annular groove 74. This tab 80 prevents the tool shaft 72 of tool 27 from backing out of the bore 71 while allowing the tool 27 and attached blade 28 to swivel.

As shown in FIGS. 12 and 13, the tab 80 is part of an actuatable locking assembly and formed as a single piece with a lever 84 and a fulcrum pin 86. The tab 80 extends from the lever 82 in a direction generally normal to the lever 84 and is a fixed distance from the fulcrum pin 86. The neck 70 includes a slot 88 extending through the wall of the neck 70 in communication with the bore 71, and a fulcrum mount 90. The slot 88 and the fulcrum mount 90 are spaced and sized so that, when the fulcrum pin 86 is attached to the fulcrum mount 90, the tab 80 can extend through the slot 88. As shown, the actuatable locking assembly includes a pair of screws 92 having threaded shafts allowing the screws 92 to be coupled to the neck, and heads 96 that retain the fulcrum pin 86 in a rotatable fashion within the fulcrum mount 90. The fulcrum pin 86 and fulcrum mount 90 are adapted to permit the lever 84 to rotate between a locked and unlocked position. When lever 84 is in the locked position, the tab 80 extends through the slot 88 and into the annular groove 74 preventing the shaft 72 from backing out of the bore 71. When the lever 84 is in the unlocked position, the tab 80 no longer resides in the annular groove 74 permitting the tool 27 to be removed from the blade head 26. The actuatable locking assembly also includes a spring 98 that biases the lever 84 toward the locked position.

In some cases, it may be desirable to prevent rotation of the tool 27 and shaft 72 relative to the neck 70. In such cases a swivel locking screw 100 is advanced through a threaded opening 102 in the neck 70 into tight contact with the shaft 72 to prevent rotation of the shaft 72 within the bore 71.

Figure 14:
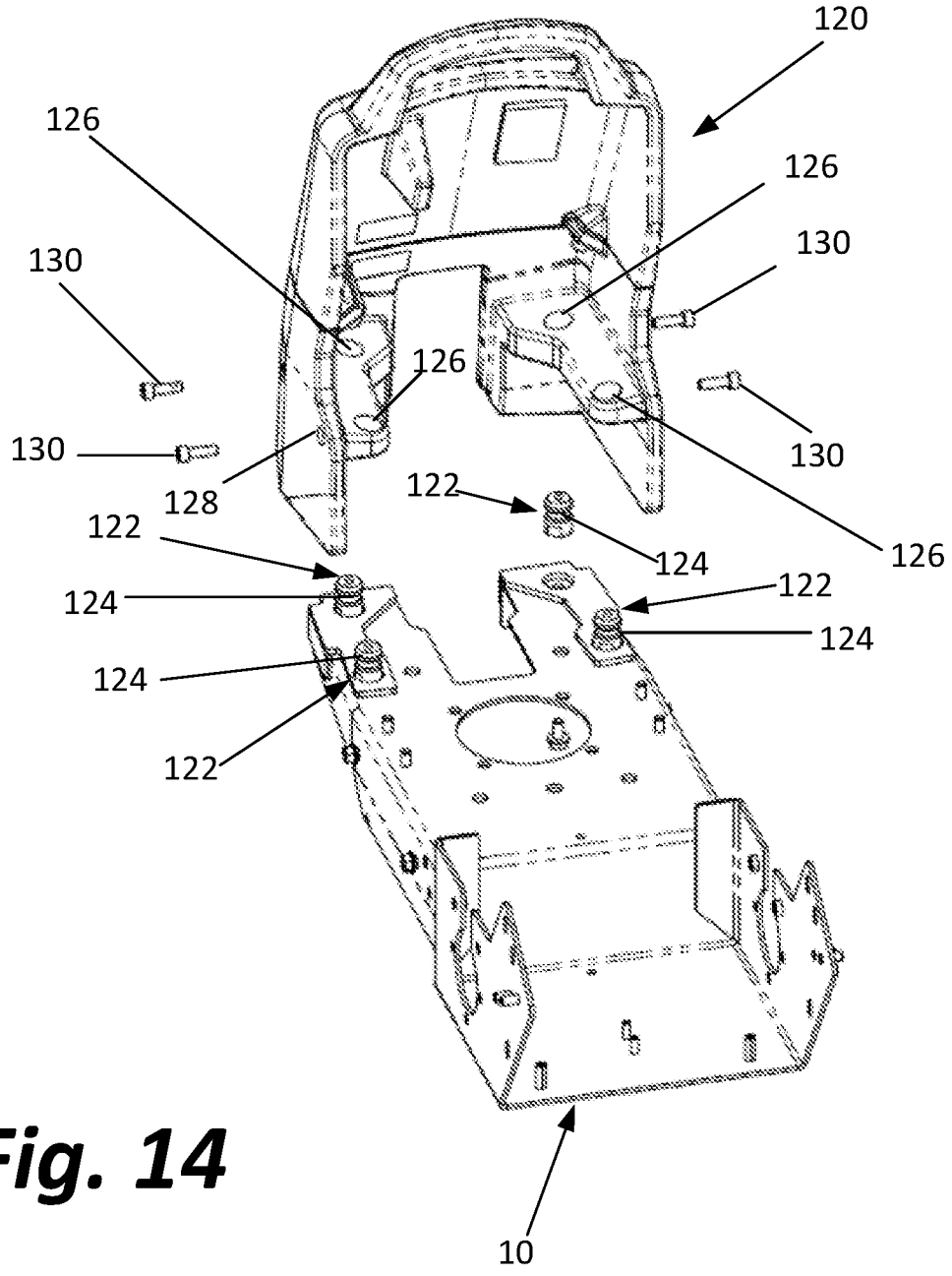
FIG. 14 is a perspective view showing how a first weight is mounted to the floor stripping machine of FIG. 1.

For efficient operation of the machine 1, it is generally required to properly balance the weight of the machine to provide a suitable downward force on the leading edge 29 of the blade 28. FIG. 14 shows a weight 120 adapted to be attached to the frame 10. As shown, the frame 10 includes four posts 122 each including an annular groove 124. The weight includes four vertical channels 126 adapted to be aligned and mate with the posts 122, and horizontal side channels 128 intersecting with the vertical channels 126. Locking pins (or set screws) 130 are adapted to be inserted through the horizontal side channels 128 and into the annular grooves 124 to lock weight 120 to the frame 10.

Figure 15:
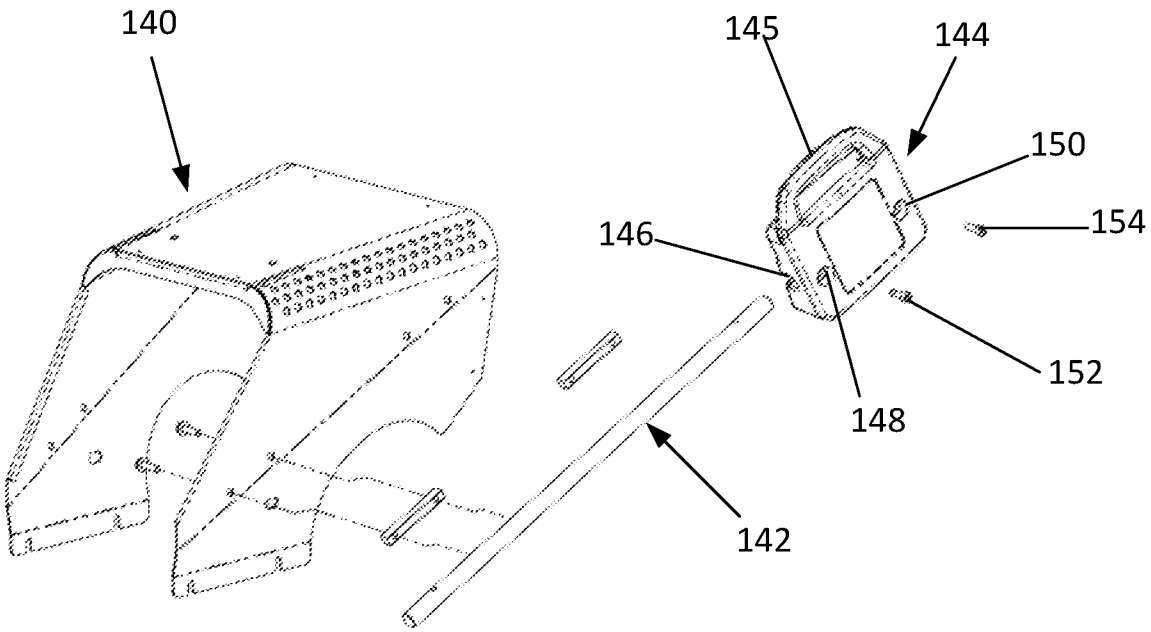
FIG. 15 is a perspective view showing how a second weight is mounted to the floor stripping machine of FIG. 1.

FIG. 15 shows a sliding weight arrangement. More specifically, FIG. 15 shows a cowling 140 adapted to be coupled to the frame 10. Mounted to the sides of the cowling 140 are weight support bars 142. FIG. 15 also shows a weight 144 having a handle 145, a weight support bar receiving channel 146, and a pair of threaded weight orifices 148 and 150 that intersect with the weight support bar receiving channel 146. A pair of set screws 152/154 are also provided. When in use, the weight 144 can be moved along the length of the weight support bar 142 to a position where proper balance for the machine 1 is achieved. The set screws 152/154 are then employed through the threaded weight orifices 148 and 150 to lock to the bar in the desired position along the bar 142.

FIG. 16 is a schematic diagram showing the electrical connections between the thumb spinners 60/61 and the other controls/indicators 62-69 of the user interface 18 to the microcomputer 19. This schematic diagram also shows connections between the microcomputer 19 and the variable frequency drives 15/15/25 associated with the wheel motors 14 and the body motor 24, and the controller for the linear actuator 54. Signals are sent back and forth along these various connections.

Figure 17:
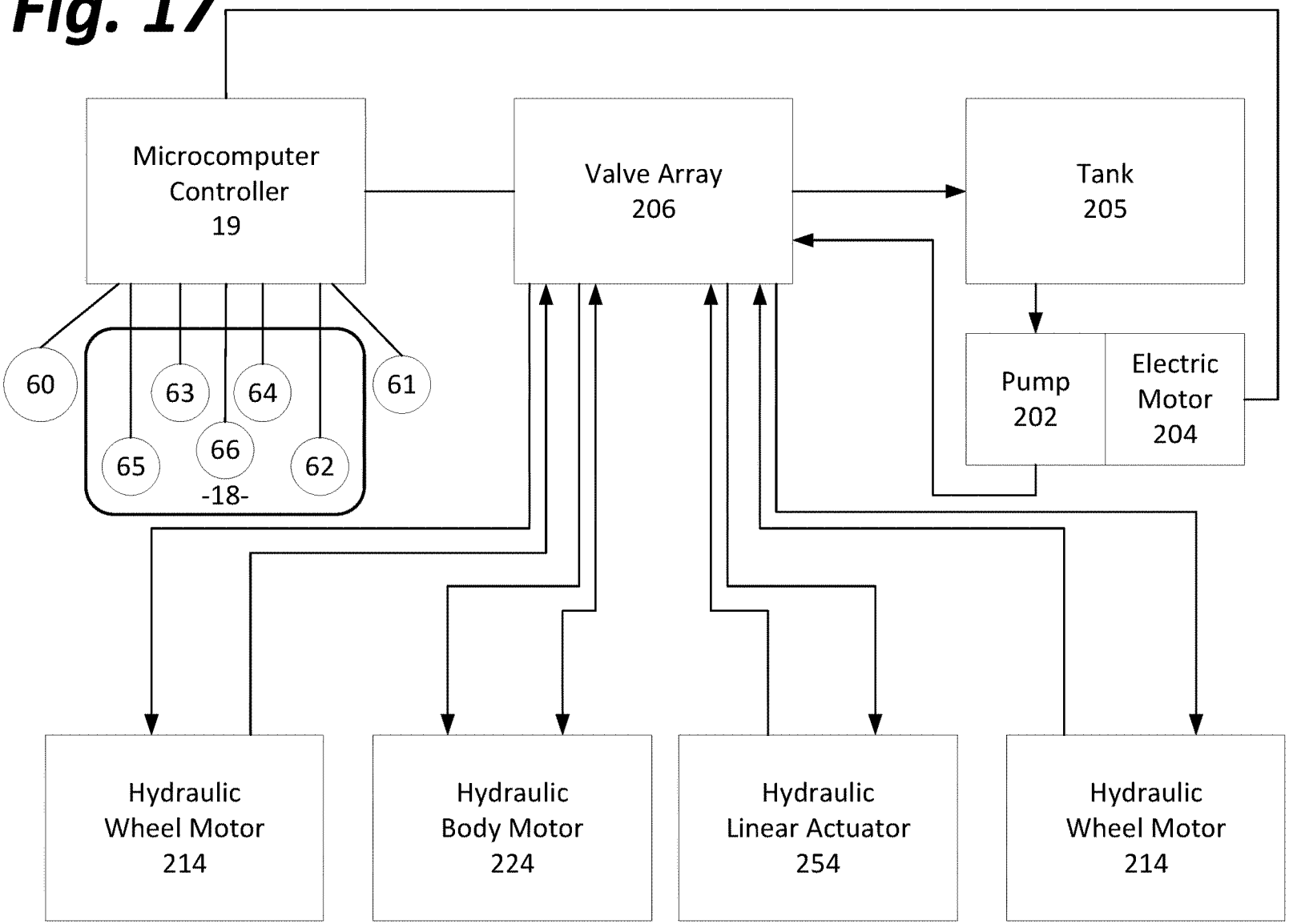
FIG. 17 is a schematic diagram of a second way of controlling the floor stripping machine of FIG. 1 when hydraulic motors are used.

While FIGS. 1-16 show an all-electric embodiment, the present invention also contemplates the use of hydraulics as shown in FIG. 17. In hydraulic embodiments, the machine 1 includes a pump 202, an electric motor 204 that drives the pump, and a tank 205 that holds a supply of hydraulic fluid. A valve array 206 replaces the variable frequency drives and the controller for the linear actuator. The wheel and body motors 214/224 are hydraulic motors rather than electric motors, and the electric linear actuator is replaced with a hydraulic linear actuator 254 such as a hydraulic cylinder. The valve array 206 comprising a manifold and a plurality of valves. Each of the valves is adapted to be mechanically controlled such as by a solenoid, and the solenoids receive control signals from the microcomputer 19. Those skilled in the art may find that the all-electric system shown in FIGS. 1-16 to be preferable when the machine 1 is a walk-behind machine and the hydraulic control system to be preferable when the machine 1 is a ride-on machine. However, a ride-on machine can be all-electric, and battery powered. And a walk-behind machine could use hydraulics rather than the electro-mechanical wheel motors, body motor and linear actuator described above. Terms such as "wheel motor" and "body motor" are intended to encompass electric and hydraulic motors, and "linear actuator" is intended to encompass any suitable electric or hydraulic actuator such as an electronic linear actuator or a hydraulic cylinder.

Within the scope of the following claims, the invention may be practiced otherwise than as specifically shown in the drawings and described above. The foregoing description is intended to explain the various features and advantages, but is not intended to be limiting. The scope of the invention is defined by the following claims which are also intended to cover a reasonable range of equivalents.

What is claimed is:

1. A floor stripper comprising:

(a) a frame supported by a plurality of wheels;

(b) an oscillating body coupled to the frame, said oscillating body oscillated with respect to the frame by an eccentric and a body motor; and (c) a blade head coupled to the oscillating body by a blade pitch adjustment mechanism, said blade pitch adjustment mechanism comprising:

(i) a linkage; and (ii) a linear actuator coupled to the linkage and adapted to manipulate the linkage to adjust the pitch of the blade head relative to the oscillating body, wherein the linkage comprises:

(1) a first bar having a lower section, an upper section, and a rearwardly projecting section;

(2) an output link having a first end and second end, the output link pivotally coupled adjacent the first end to the lower section of the first bar and pivotally coupled adjacent the second end to the blade head; and (3) a bellcrank comprising a hub, a first arm extending from the hub, the first arm pivotally coupled to the rearwardly projecting section of the first bar, and a second arm extending from the hub pivotally coupled to the blade head, and wherein the linear actuator is an electro-mechanical linear actuator coupled to the hub of the bellcrank and to the upper section of the first bar.

2. The floor stripper of claim 1 wherein said body motor is an electric motor and is coupled to a first variable frequency drive.

3. The floor stripper of claim 1 wherein said output link is coupled to a center portion of the blade head.

4. The floor stripper of claim 1 wherein said second arm extending from the hub of the bellcrank is pivotally coupled to an upper portion of the blade head.

5. The floor stripper of claim 1 wherein each of the plurality of wheels is driven by a separate electric motor coupled to a separate variable frequency drive.

6. The floor stripper of claim 1 further comprising an electric motor, a pump coupled to the electric motor, a tank adapted to hold hydraulic fluid, a valve array comprising a plurality of valves adapted to separately regulate the flow of hydraulic fluid to and the speed of a motor operably coupled to one of the plurality of wheels, the body motor, and the linear actuator.

7. The floor stripper of claim 1 further comprising a user interface, and a microcomputer adapted to control operation of the floor stripper in accordance with a programmable set of instructions and signals received from the user interface.

8. The floor stripper of claim 7 wherein the user interface cooperates with the microcomputer to allow an operator to control the speed and direction of rotation of a motor operably coupled to one of the plurality of wheels.

9. The floor stripper of claim 7 wherein the user interface cooperates with the microcomputer to allow an operator to control the speed at which the oscillating body oscillates.

10. The floor stripper of claim 7 wherein the user interface cooperates with the microcomputer to allow an operator to control the linear actuator to adjust the pitch of the blade head.

11. The floor stripper of claim 1 further comprising a weight support bar, at least one weight adapted to slide along the weight support bar and means for locking the weight to the support bar in the desired position along the weight support bar.

12. A floor stripper comprising:

a frame supported by a plurality of wheels;

an oscillating body coupled to the frame, said oscillating body oscillated with respect to the frame by an eccentric and a body motor;

a blade head coupled to the oscillating body by a blade pitch adjustment mechanism, said blade pitch adjustment mechanism comprising (i) a linkage and (ii) a linear actuator coupled to the linkage and adapted to manipulate the linkage to adjust the pitch of the blade head relative to the oscillating body; and a blade holding tool having a shaft and wherein said blade head comprises a neck having a bore adapted to receive the shaft, wherein said shaft has an annular groove and a stop, and the neck has a front surface adapted to engage the stop and a slot aligned with the annular groove when the stop engages the front surface.

13. The floor stripper of claim 12 further comprising an actuatable locking assembly adapted to selectively retain the shaft of the blade holding tool within the bore of the neck of the blade head.

14. The floor stripper of claim 13 wherein said actuatable locking assembly includes a lever having a tab and rotatable about an axis between a locked position in which the tab extends from the lever through the slot and into the annular groove, and an unlocked position in which the tab is outside of the annular groove.

15. The floor stripper of claim 14 wherein the actuatable locking assembly further comprises a spring adapted to bias the lever toward the locked position.

* * * * *